US011633870B1

(12) United States Patent
Woodford

(10) Patent No.: US 11,633,870 B1
(45) Date of Patent: Apr. 25, 2023

(54) COMPRESSION/CORNER-CUT BOX REDUCER

(71) Applicant: Scott Woodford, Las Vegas, NV (US)

(72) Inventor: Scott Woodford, Las Vegas, NV (US)

( * ) Notice: Subject to any disclaimer, the term of this patent is extended or adjusted under 35 U.S.C. 154(b) by 0 days.

(21) Appl. No.: 17/098,311

(22) Filed: Nov. 13, 2020

Related U.S. Application Data

(60) Provisional application No. 62/935,711, filed on Nov. 15, 2019.

(51) Int. Cl.
*B26B 29/02* (2006.01)
*B26B 27/00* (2006.01)
*B26B 29/06* (2006.01)

(52) U.S. Cl.
CPC ..... *B26B 29/06* (2013.01); *B26B 27/005* (2013.01)

(58) Field of Classification Search
None
See application file for complete search history.

(56) References Cited

U.S. PATENT DOCUMENTS 2,679,104 A * 5/1954 Whitton ..... B26D 3/085 33/42
2,948,960 A * 8/1960 Eckstein ..... B26B 1/08 30/162
3,191,295 A * 6/1965 Falk ..... B31B 50/99 30/2
3,304,613 A * 2/1967 Shawhan ..... B31F 1/08 33/42
3,344,718 A * 10/1967 Schollard ..... B26D 1/147 493/354
D257,552 S * 11/1980 Sobol ..... 30/2
4,825,549 A * 5/1989 Huang ..... B26B 27/005 30/2
D399,147 S * 10/1998 Tang ..... D10/70
6,615,495 B1 * 9/2003 Evens ..... B26B 29/06 30/2
10,857,687 B1 * 12/2020 Laupan ..... B26B 29/06

* cited by examiner

*Primary Examiner* — Hwei-Siu C Payer
(74) *Attorney, Agent, or Firm* — Nguyen & Yip, P.C.; Wai Tai Yip

(57) ABSTRACT

A box reducer for trimming or reducing the size of a cardboard box is disclosed. The current invention allows an operator to reduce the size of an existing cardboard box after unnecessary material is removed by a knife or a cutter. The current invention improves prior arts in two ways. First, the invention contains a stabilizer which allows itself to travel in a stable way along the top edge of the flaps of the cardboard box while marking a line to be folded to create the cover of the box. Second, instead of using perforation as prior arts do, this invention uses compression to create the line on the flaps of the cardboard box. Then the operator can fold along the line to create the covering flaps, thus, a reduced box.

3 Claims, 8 Drawing Sheets

Current invention

Stabilizer and anti-rotation Fence

Handle and Stylus

Prior art tends to swing upwards

Current device makes straight creases.

Hand positions prior art vs new invention

Unscored part of box. Prior art vs new invention

COMPRESSION/CORNER-CUT BOX REDUCER

CROSS-REFERENCE TO RELATED APPLICATIONS

This application claims the benefit of Provisional Patent Application (PPA) No. 62935711, filed Nov. 15, 2019 by the present Inventor, which is incorporated by reference in its entirety.

FEDERALLY SPONSORED RESEARCH AND DEVELOPMENT

Not Applicable.

SEQUENCE LISTING OR PROGRAM

Not Applicable

BACKGROUND

Field of the Invention

This invention relates to a box reducer for trimming or reducing the size of a cardboard box.

Discussion of Related Art

In packaging items for shipping purpose, it is often necessary to make a box fit the size of its contents since most boxes come with standard sizes. The objective is to reduce the amount of packing material needed for shipping. This could save weight, shipping costs, and avoid unnecessary environmental waste in the form of packing fillers.

The inventor has recognized that there are a few issues with the existing box-reducing tools. Most prior arts operate in a similar way.

1. A prior art (FIG. 2) available in the market use a pointed wheel to make perforations in a line (See FIG. 8 Part 16). A shortcoming of this perforation wheel is that its diameter is too large to go all the way into the box corners. Since the corners are not scored, the result is usually an uneven fold at the corners.
2. A problem with perforation is that it cuts one side of the cardboard. If the operator scores the cardboard more than once, or if the box flap is folded away from the side perforated, the box flap is nearly disconnected, held only by a thin paper skin. If this skin tears, the flap comes off and the box is ruined.
3. In addition, it is difficult to create a straight line. The depth gauge is so narrow, that as the tool is moved along the side of the box, the perforating wheel tends to swing in an upwards arc (FIG. 5). The operator must counter this tendency by holding the device with two hands and moving them at the exact same speed. Since this is difficult to do, the result is usually a wavy perforation line.
4. The handle of the prior art is solidly fixed to the shaft of the device. It sticks out perpendicularly to the side of the box being perforated. This leaves little room for the operator's hand between handle and adjacent wall, either when starting or finishing the perforation stroke. This could obstruct getting the perforation fully into the corner of a box. (FIG. 7)
5. Perforating wheel and its cowling can interfere with the contents of the box as the device travels across the side of the box. Box contents often have an amount of recoil when pressed. This characteristic can raise the height of the box contents above the desired trim level. When this happens, the prior art forces the operator to remove some, or all, of the contents while the device is used. So, the operator must fill the box to find the desired height, empty the box to use the device, then refill the box. These are two unnecessary steps.

SUMMARY OF THE INVENTION

This invention utilizes a mechanism to stabilize the box reducer while traveling along the top edge of the flap of a cardboard box. In addition, it also uses a stylus to employ compression to create a crease such that the 4 flaps on the 4 sides of the box could be folded along the crease line.

The invention includes a body (an elongated body or shaft), a middle portion (stabilizer), and a bottom portion (stylus and handle). The stabilizer is incorporated with a depth gauge. The stabilizer is a metal, wood or plastic plate that extends laterally from the shaft. The stabilizer keeps the device on a straight path as it is moved across the side of the cardboard box.

The stylus is a hard ball-like element. It is narrower than a perforation wheel often used in prior arts. Thus, the stylus can get into the box corners. Since compression is used instead of perforation, cardboard fibers are not cut, and the flap can be folded in either direction without the cardboard tearing. Multiple passes can be done to ensure a crease of desired length or depth without tearing the cardboard. Creasing can be done on both sides of the cardboard to enable folding the flaps in either direction. The stylus is free to rotate around the shaft. This rotating stylus/handle keeps the operator's hand from bumping sidewalls. The stylus/handle assembly is attached to the shaft by a bolt in a manner that allows the stylus and handle to rotate. Since the stylus and handle are on the opposite sides of a rotation axis defined by the bolt (25), the stylus can go virtually all the way into a corner while the handle stays away from the sides of the box.

With the current invention, only one hand is needed to move the device to make a crease. The other hand is free to compress box contents that are springy. Therefore, the content inside the box does not need to be emptied to operate the device, then refilled. Also, the stylus is mounted on a narrow extension that is close to the box sides and has minimal or no contact with the box contents.

DESCRIPTION OF THE DRAWINGS

FIG. 1 shows an embodiment of this invention and its major parts. It has a shaft (17), the stabilizer/gauge assembly (11), and the stylus/handle Assembly (14,15). The stabilizer/gauge assembly can slide along the shaft to a desired position where a set screw (12) will hold it in place. This determines where a crease will be made in the cardboard. The stylus/handle assembly is attached to the shaft by a bolt (not visible in this figure) in a manner that allows the stylus/handle assembly to rotate.

FIG. 2 shows a prior art that has a shaft (17), depth gauge (18), and perforator/handle assembly (16,19). The depth gauge can slide along the shaft to a desired position where a set screw will hold it in place. The perforator/handle assembly is attached to the shaft by a bolt in a manner that allows the perforating wheel to turn. The handle is fixed relative to the shaft.

FIG. 3 shows multiple views of the stabilizer (11), anti-rotation fence (13), and the cowling (20).

FIG. 4 shows two perspectives of the stylus/handle assembly (14, 15). The stylus is a cap nut (14) that is bolted to the handle assembly. The stylus/handle assembly can rotate around a bolt (25) that holds it to the shaft.

FIG. 5 depicts the difficulty for the prior art in making straight lines. Curved dashed lines show the direction that the perforator tends to go as a sideways force is applied to the handle. Operator must counter this tendency by using two hands moving at the exact same speed. Since this is difficult to do, the result is usually a wavy perforation line.

FIG. 6 depicts how the current invention makes straight lines. The stabilizer shown here counteracts the arcing tendency making it easy to make a straight crease.

FIG. 7 shows a comparison of an operator's hand position when using the prior art and the current invention. Since the prior art handle is fixed in relation to the shaft, the operator's hand can hit the adjacent walls of a box at the start or end of the perforating motion. This can make it awkward to get the perforator all the way into the corner of a box. Since the current invention's handle rotates, it stays away from the sides of the box for the whole creasing motion. The handle does not impede the stylus from getting into the box corners.

FIG. 8 shows a comparison of a stylus (of the current invention) vs a perforator (of a prior art) in cutting the corner of a box. The circular basic shape of a perforating wheel cannot go all the way into a corner. However, a narrower stylus can get virtually all the way in, resulting in cleaner folds.

DETAILED DESCRIPTION OF THE PREFERRED EMBODIMENT

Figure 1:
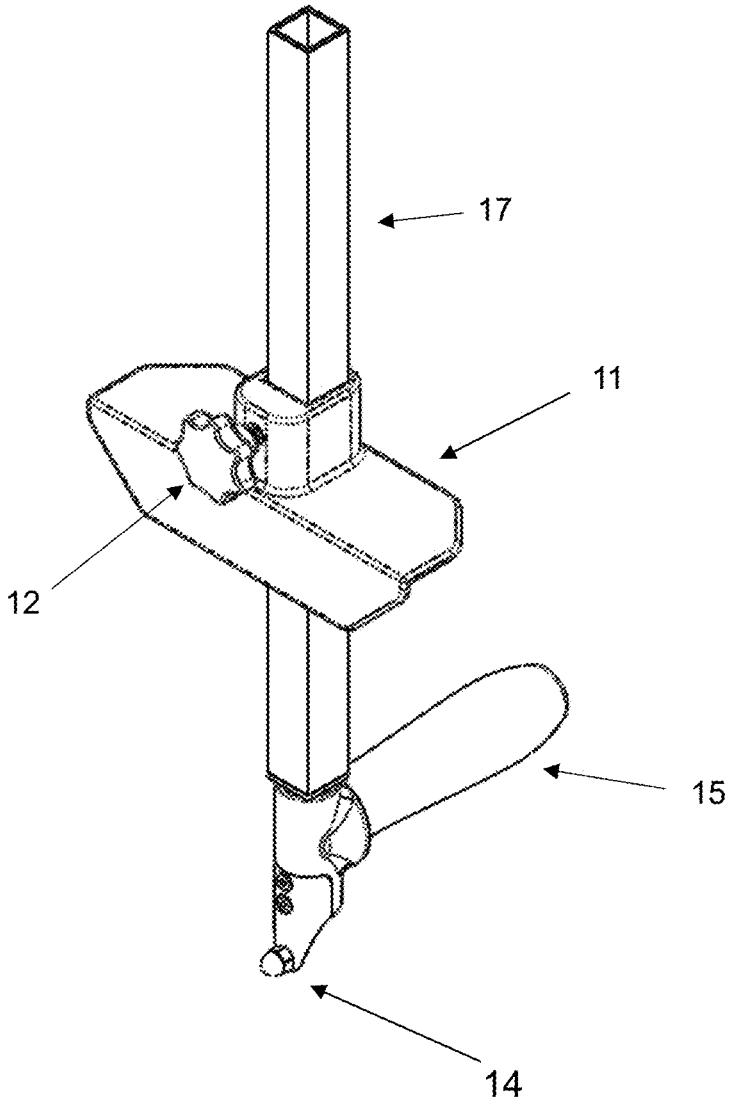
FIG. 1 depicts a perspective view of this box reducer.
Figure 2:
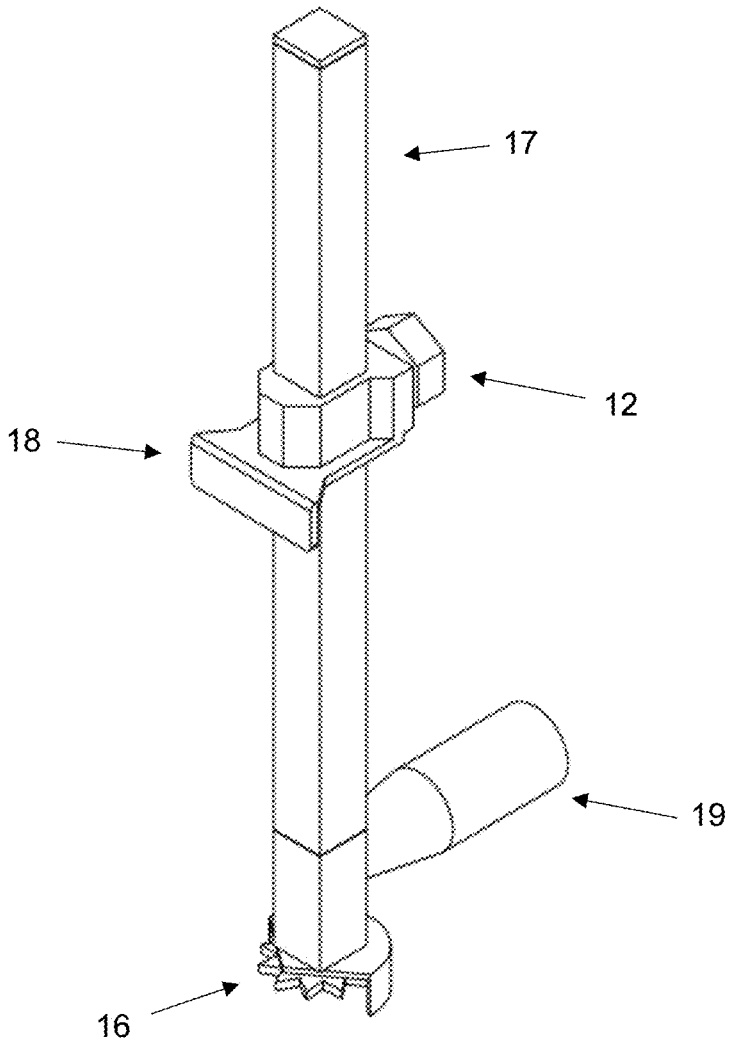
FIG. 2 Prior Art
FIG. 2 depicts a prior art.

A preferred embodiment is shown in FIG. 1. It has a shaft (17), the stabilizer/gauge assembly (11), and the stylus/handle Assembly (14,15). The stabilizer/gauge assembly can slide along the shaft to a desired position where a set screw will hold it in place. This determines where a crease will be made in the cardboard. The stylus/handle assembly is attached to the shaft by a bolt (not visible in this figure) in a manner that allows the stylus/handle assembly to pivot.

It improves upon the prior art by

Figure 8:
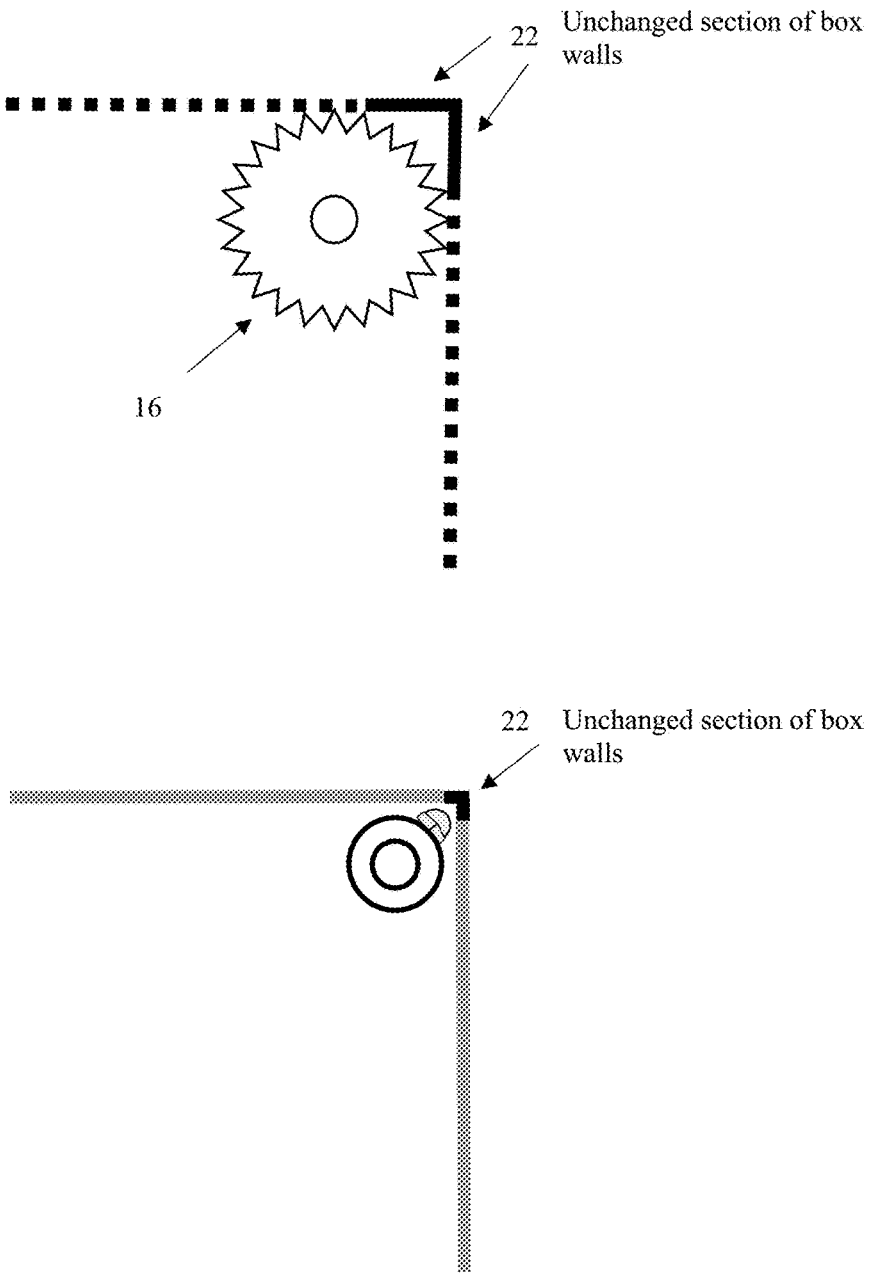
FIG. 8 depicts a different view of the same difference illustrated in FIG. 7.

1. A stylus that goes all the way into corners (FIG. 8).

The stylus is narrower than the perforation wheel. Thus, the stylus can get into the box corners.

2. The use of compression to form a crease.

Since compression is used instead of perforation, cardboard fibers are not cut, and the flap can be folded in either direction without the cardboard tearing. Multiple passes can be done to ensure a crease of desired length or depth without tearing the cardboard. Creasing can be done on both sides of the cardboard to enable folding the flaps in either direction.

3. A stabilizer to make straight creases.

Figure 3:
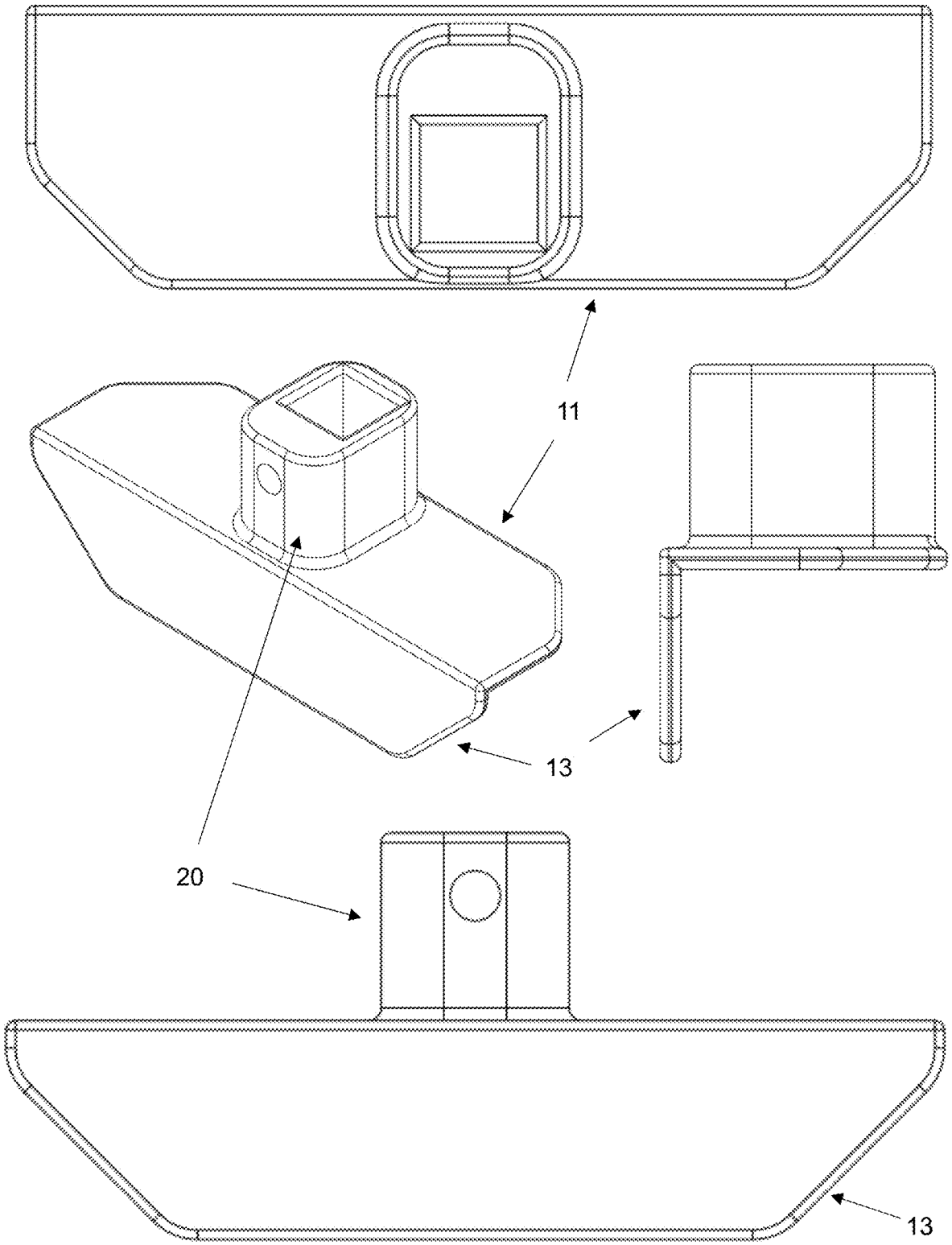
FIG. 3 depicts enlarged views (from different angles) of the stabilizer.
Figure 6:
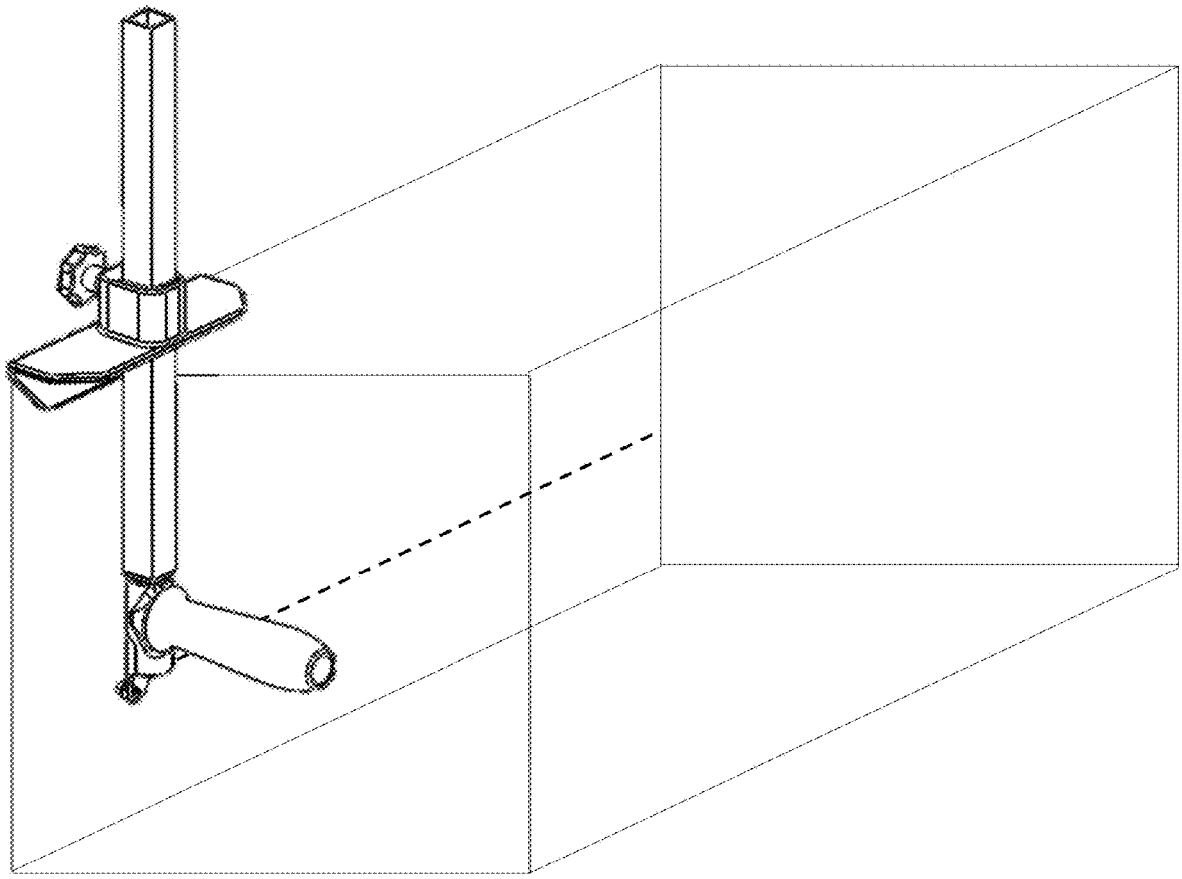
FIG. 6 depicts how current invention makes straight lines.

In FIG. 3, it shows multiple views of the stabilizer (11), anti-rotation fence (13), and the cowling (20). The stabilizer is incorporated with the depth gauge. This is a metal, wood or plastic plate that extends laterally from the shaft. It keeps the device on a straight path as it is moved across the side of the cardboard box. (See FIG. 3 and FIG. 6)

4. A pivoting stylus/handle.

Figure 4:
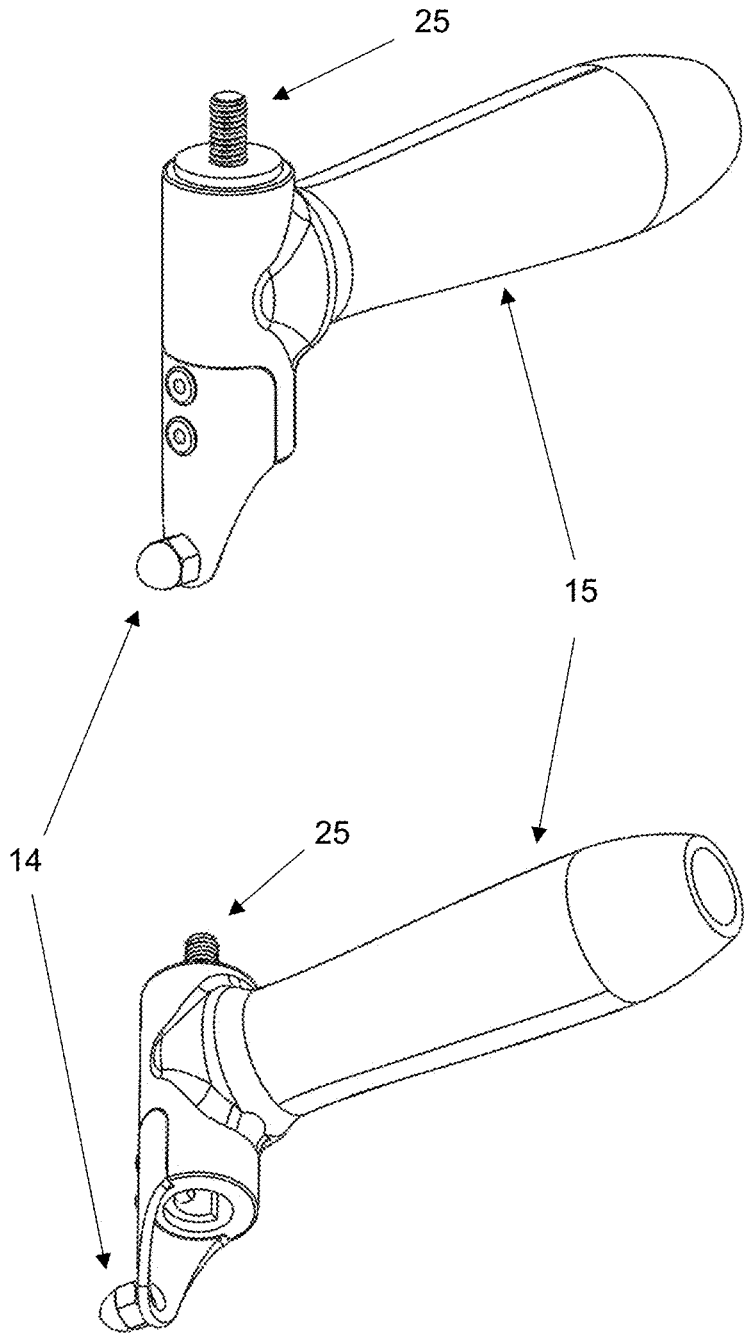
FIG. 4 depicts an enlarged view of the stylus/handle.
Figure 5:
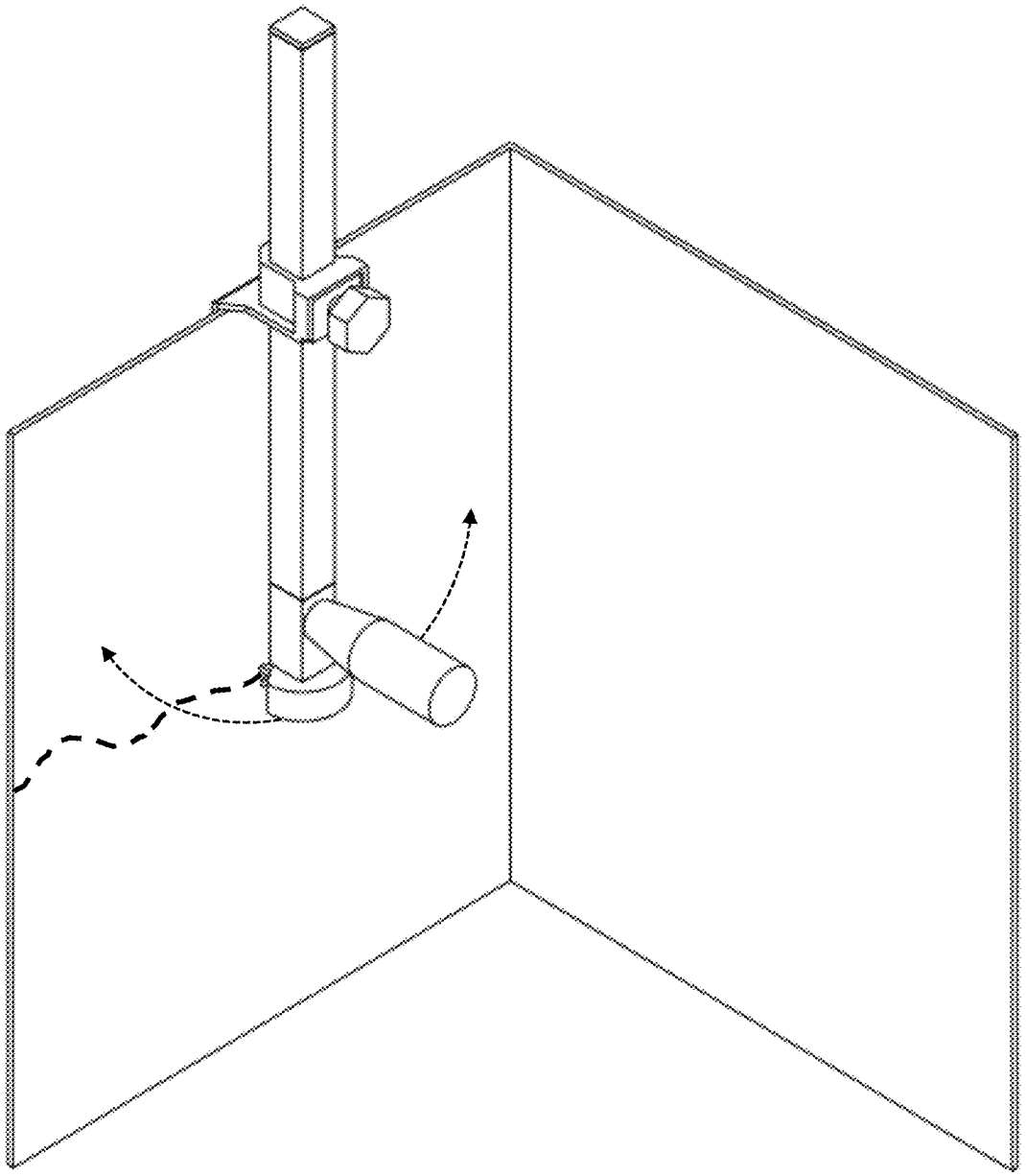
FIG. 5 depicts the prior art's difficulty in making straight lines.
Figure 7:
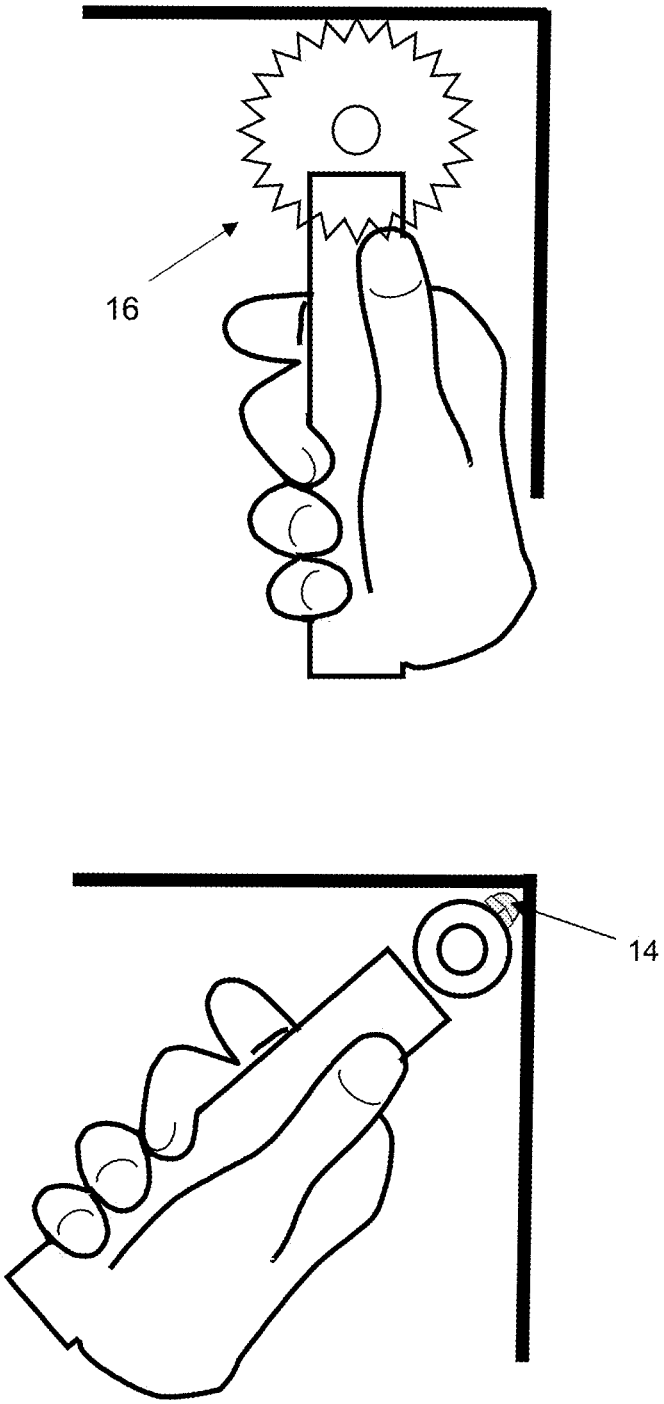
FIG. 7 depicts another difference between the prior art and the invention.

This pivoting stylus/handle keeps the operator's hand from bumping sidewalls. The stylus/handle assembly is attached to the shaft by a bolt in a manner that allows the stylus and handle to pivot. (See FIG. 1 and FIG. 4). The stylus is a cap nut (14) that is bolted to the handle assembly. The stylus/handle assembly can pivot around a bolt (25) that holds it to the shaft. Since the stylus and handle are on the opposite sides of the pivot point, the stylus can go virtually all the way into a corner while the handle stays away to from the sides of the box (FIG. 7).

5. Contents can Stay in the Box.

Only one hand is needed to move the device to make a crease. The other hand is free to compress box contents that are springy. Therefore, the content inside the box does not need to be emptied to operate the device, then refilled. Also, the stylus is mounted on a narrow extension that is close to the box sides and has minimal or no contact with the box contents. (See FIGS. 1, 3 and 4*b*).

What is claimed is:

1. A box reducer, comprising:

an elongated body;

a stabilizer removably secured to said elongated body by a cowling; said stabilizer having an anti-rotation fence; and a bottom portion removably secured to said elongated body, said bottom portion having a stylus and a handle, wherein said stylus is in the form of a cap nut and is attached to said handle.

2. A box reducer as in claim 1 wherein said stabilizer can move along said elongated body and be secured to said elongated body by a screw.

3. A box reducer as in claim 1 wherein said bottom portion can rotate with respect to said elongated body.

* * * * *